US007469945B2

(12) United States Patent
Dennis

(10) Patent No.: US 7,469,945 B2
(45) **Date of Patent: *Dec. 30, 2008**

(54) ADJUSTABLE STRIKER ASSEMBLY

(75) Inventor: Robert P. Dennis, Royal Oak, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/676,515

(22) Filed: Feb. 20, 2007

(65) Prior Publication Data

US 2008/0197643 A1 Aug. 21, 2008

(51) Int. Cl.
*E05B 15/02* (2006.01)
*E05C 21/02* (2006.01)

(52) U.S. Cl. ..... 292/340; 292/341.18

(58) Field of Classification Search ..... 292/340, 292/341.18

See application file for complete search history.

(56) References Cited

U.S. PATENT DOCUMENTS 4,451,071 A 5/1984 Striese et al.
4,538,843 A * 9/1985 Harris ..... 292/113
4,691,952 A 9/1987 Harmon
4,798,408 A 1/1989 Harmon et al.
4,852,923 A * 8/1989 Harmon et al. ..... 292/341.18
4,906,037 A 3/1990 Stammreich et al.
5,016,931 A * 5/1991 Jackson ..... 292/341.18
5,226,302 A 7/1993 Anderson
6,382,690 B1 5/2002 Dessenberger, Jr.
7,111,881 B2 9/2006 Paskonis
7,360,810 B2 * 4/2008 Dennis ..... 292/341.18

* cited by examiner

*Primary Examiner*—Carlos Lugo

(57) ABSTRACT

A striker assembly, and method of forming, for use with a closure for a vehicle compartment is disclosed. The striker may have a main shaft with a hoop extending from a first end, threads extending around the main shaft, and a rotational retention feature adjacent to the threads. A bracket may have a pair of mounting flanges, a first wall including a threaded hole therethrough that engages the threads, a second wall, spaced from the first wall, having a hole therethrough that engages the main shaft, and a flexible arm having a catch engageable with the rotational retention feature.

15 Claims, 3 Drawing Sheets

ADJUSTABLE STRIKER ASSEMBLY

BACKGROUND OF THE INVENTION

The present invention relates generally to a striker for a vehicle closure, and in particular to an adjustable striker assembly for engaging a latch on a compartment door.

Closures in vehicles commonly have a latch and striker type of arrangement for holding the closure in its closed position. Often, the latch will be mounted to the closure with a button or other type of release mechanism controlling the latch. A striker is then mounted to a vehicle component or structure and located so the latch will engage the striker when the closure is moved to its fully closed position. The latch engagement with the striker then holds the closure in its closed position until the button is actuated to release the latch from the striker.

A common use for a latch and striker assembly is a vehicle glove box, with the latch mounted to the glove box door and the striker mounted to the glove box portion of an instrument panel. The glove box door is fitted to provide a flush fitting condition. In modern vehicles, the styled surfaces of instrument panels typically do not provide natural overhangs or features that will hide improper door fit. Consequently, for proper aesthetics, automotive glove box doors are required to fit nearly perfectly on every vehicle.

When an automotive instrument panel is assembled and the various components are fitted, the flushness can be accomplished relatively easily, resulting in good appearance and satisfying the desired styling look for the instrument panel assembly. After this instrument panel assembly is shipped from the supplier to the automotive assembly plant and attached to the vehicle body, however, these fits invariably change. This may be due to changes in the instrument panel assembly during shipping and handling, as well as variances in each automotive body that may distort the instrument panel assembly when attached to the automotive body. The change in the fit of the glove box door, then, may necessitate an adjustment to assure the latch and striker assembly engage properly.

Typical strikers used with glove box closures are made of bent steel wire, which is welded to a steel plate that is then riveted or screwed to the instrument panel. Many times the strikers are not precisely located when installed on the instrument panel—due to tolerances in locating the plate or twisting that may occur when mounting screws are tightened. These tolerances may add to the concern with the glove box door fit.

Because the flush fit of the door is important to the appearance and quality of the vehicle interior—despite the fact that every instrument panel is installed into a vehicle body that has some variation due to manufacturing tolerances—the strikers must be readjusted by assembly personnel on most vehicles.

In addition, the need arises—whether due to instrument panel installation variations, striker installation variations, or both—to adjust the striker so the latch will engage properly with it when the glove box door is closed. Conventionally, this adjustment is accomplished by guessing what adjustment is needed and manually bending the wire of the striker. This is a very crude and inexact process that often results in the striker being bent and moved in unintended directions. The unwanted distortion from this crude adjustment process may increase the friction between the latch and striker and so may raise operating efforts—even possibly cause some binding in the latching assembly. Moreover, this crude alignment process may add to labor costs, and also may risk damaging the striker. Thus, the adjustment process, while assuring that the latch will engage the striker, may prevent the smooth operation of the latch and striker assembly and add to the vehicle assembly costs.

It is desirable, therefore, to provide a striker that is used with a latch on a vehicle closure that allows for easy and accurate adjustment of the striker to assure that the latch and striker assembly works smoothly and properly when the closure is properly aligned with its compartment.

SUMMARY OF THE INVENTION

An embodiment contemplates a striker assembly for use with a closure for a vehicle compartment. The striker assembly may comprise a striker and a bracket. The striker may have a main shaft with a first end and an opposed second end, a hoop extending from the first end, threads extending around the main shaft, and a rotational retention feature adjacent to the threads on the main shaft. The bracket may have a pair of mounting flanges adapted to be mounted to one of the closure and the vehicle compartment, a first wall including a threaded hole therethrough that operatively engages the threads on the main shaft, a second wall, spaced from the first wall, having a hole therethrough that engages the main shaft to allow for axial and rotational movement of the main shaft relative to the second wall, and a flexible arm having a catch operatively engageable with the rotational retention feature such that the flexible arm is in a substantially relaxed position when the catch is aligned with the rotational retention feature and is in a flexed position when the catch is not aligned with the rotational retention feature.

An embodiment contemplates a method of forming an adjustable striker assembly that can be used with a closure for a vehicle compartment, the method comprising the steps of: forming a striker having a main shaft with a first end and an opposed second end, a hoop extending from the first end, threads extending around the main shaft, and a rotational retention feature adjacent to the threads on the main shaft; and insert molding a single piece bracket around the striker, including forming a first wall including a threaded hole therethrough that engages the threads on the main shaft, a second wall, spaced from the first wall, having a hole therethrough that engages the main shaft, and a flexible arm having a catch engaging the rotational retention feature such that the flexible arm is in an as molded position when the catch is aligned with the rotational retention feature and is in a flexed position when the catch is not aligned with the rotational retention feature.

An embodiment contemplates a striker assembly mounted to a vehicle glove box and adapted to engage a latch of a glove box door. The striker assembly may comprise a striker having a main shaft with a first end and an opposed second end, a hoop extending from the first end and adapted to engage the latch, threads extending around the main shaft adjacent to the second end, and a rotational retention feature on the main shaft between the threads and the hoop; and a bracket having a pair of mounting flanges mounted to the vehicle glove box, a first wall including a threaded hole therethrough that operatively engages the threads on the main shaft, a second wall, spaced from the first wall, having a hole therethrough that engages the main shaft adjacent to the first end, and a flexible arm having a catch operatively engageable with the rotational retention feature, the bracket being a single, monolithic piece.

An advantage of an embodiment is that the adjustable striker assembly is relatively quick and easy to adjust to assure proper alignment with a corresponding latch. In addition, the initial torque required to initiate the adjustment is relatively low because there need only be one V-groove engaged with one flexible arm to hold the striker in the correct position after adjustment. And the adjustment friction (torque required to rotate the striker and effect the adjustment) is relatively low due to the fact that there only needs to be one engaged adjustment thread between the bracket and striker.

An advantage of an embodiment is that the adjustable striker assembly can be adjusted while minimizing the risk of damaging the striker, thus assuring smooth operation of the latch and striker assembly without increased friction or binding concerns.

An advantage of an embodiment is that the adjustable striker assembly may not require assembly of separate components since the bracket body can be formed on the striker. With only two parts, the striker assembly is relatively simple and durable.

An advantage of an embodiment is that the adjustable striker assembly can be adjusted easily without tools, and yet maintain the proper position after adjustment.

DETAILED DESCRIPTION

Figure 1:
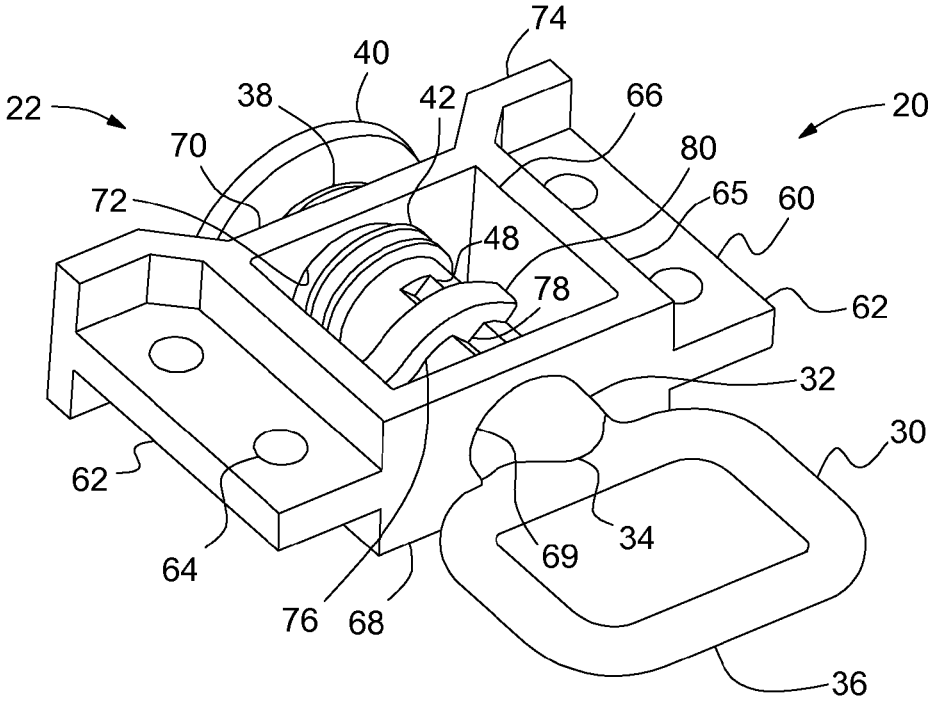
FIG. 1 is a perspective view of a striker assembly according to a first embodiment.
Figure 2:
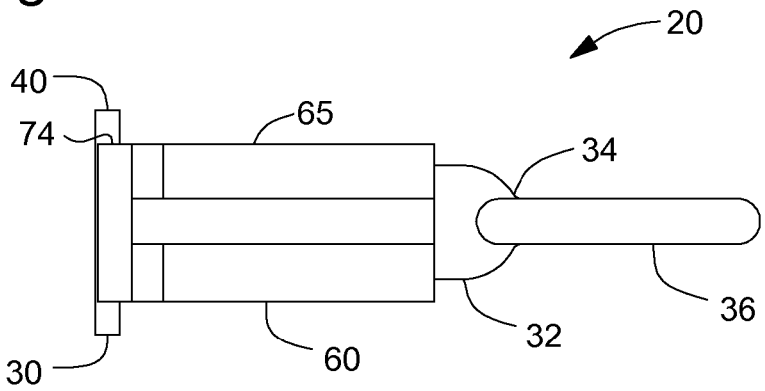
FIG. 2 is a side view of the striker assembly of FIG. 1.
Figure 3:
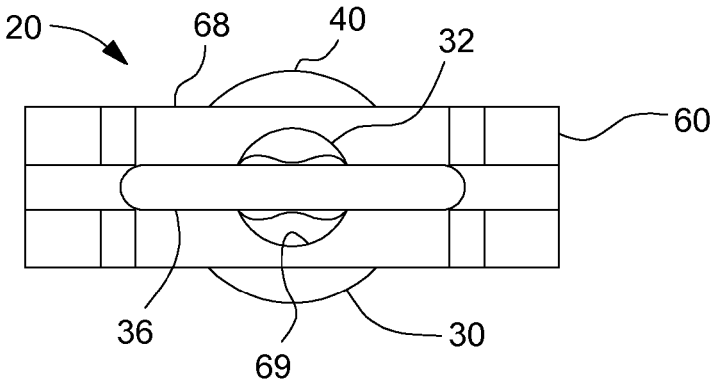
FIG. 3 is an end view of the striker assembly of FIG. 1.
Figure 4:
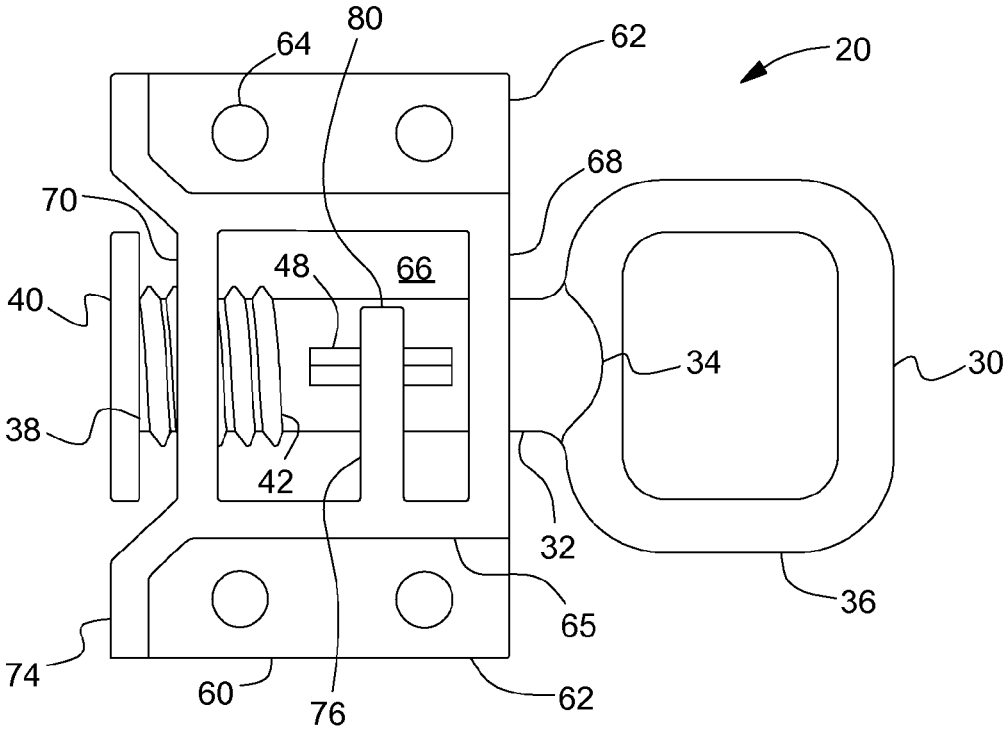
FIG. 4 is a plan view of the striker assembly of FIG. 1.

FIGS. 1-4 illustrate a striker assembly, indicated generally at 20, which engages with a latch (not shown) of a latch and striker assembly, indicated generally at 22. The striker assembly 20 is mounted to one of a door or compartment (not shown in the first embodiment), with the latch being mounted to the other of the door or compartment. The striker assembly 20 may be secured to the door or compartment with rivets (not shown in the first embodiment) or other suitable fastening mechanisms. The compartment may be, for example, a glove box opening in an instrument panel.

The striker assembly 20 includes a striker 30. The striker 30 may be made of, for example, a metal such as steel—although, other suitable materials may be employed instead. The striker 30 includes a main shaft 32, which is generally cylindrical, having a first end 34 from which a D-shaped hoop 36 extends, and a second end 38 from which a retention flange 40 extends. Both the retention flange 40 and the hoop 36 will resist impact loading, preventing the striker 30 from being either pulled or pushed out of a bracket (discussed below) of the striker assembly 20. The hoop 36 may be formed into shapes other than the D-shape, if so desired.

The striker 30 also has threads 42 formed onto its main shaft 32 adjacent to the retention flange 40. Recessed within the main shaft 32, between the threads 42 and D-shaped hoop 36, are two V-grooves 48. These V-grooves 48 are oriented to extend longitudinally on the main shaft 32 and be located one hundred eighty degrees apart from each other. While having the V-grooves 48 recessed into the main shaft 32 creates one type of catch, other types of rotational retention features that will selectively catch and release the striker 30 from the bracket (discussed below) for selective rotation may be employed instead, if so desired. Moreover, while it is preferred to have a pair of V-grooves 48, the striker 30 may include only one if so desired.

The striker assembly 20 also includes a bracket 60. The bracket 60 may be formed from, for example, molded plastic, or other suitable materials. The bracket 60 has mounting flanges 62 with mounting holes 64 for receiving the fasteners when securing the striker assembly 20 to the compartment or door. Side support walls 65—extending generally parallel to the main shaft 32 and normal to the plane of the mounting flanges 62—define a central opening 66 through which the striker 30 extends. Rear support walls 74 extend from the side support walls 65, adjacent to and on both sides of the retention flange.

The bracket 60 includes a trunnion plate 68 that surrounds and supports the main shaft 32 of the striker 30 at an end of the central opening 66 adjacent to the D-shaped hoop 36. The trunnion plate 68 defines an opening 69 that is generally smooth and circular where it contacts the main shaft 32 of the striker 30. Thus, when the striker 30 is rotated relative to the bracket 60, the trunnion plate 68 allows rotation without significant resistance, while providing support for the striker 30 (i.e., providing a bearing function).

The bracket 60 also includes an end wall 70 that surrounds and supports the main shaft 32 at the location of the threads 42, adjacent to the retention flange 40. The end wall 70 extends parallel to the trunnion plate 68. The end wall 70 defines a threaded hole 72 that engages the threads 42 on the main shaft 32. Accordingly, when the striker 30 is rotated relative to the bracket 60, the engagement of the threads 42 with the threaded hole 72 will cause the striker 30 to also move axially relative to bracket 60 by an amount determined by the pitch of the threads 42. The threaded hole 72 also provides a bearing surface for the striker 30.

A flexible arm 76 extends from one of the side support walls 65 into the central opening 66, and has a free end 80 adjacent to the main shaft 32 of the striker 30. Near the free end 80, a catch, such as a barb 78, extends from the arm 76 toward the main shaft 32 and is shaped to engage the V-groove 48. The axial location of the barb 78 relative to the V-groove is such that, as one rotates the striker 30 relative to the bracket 60, the barb 78 will engage each V-groove (when rotationally aligned) for the full distance of axial travel (in both directions) of the striker 30 relative to the bracket 60. The barb 78 and V-grooves 48 are located so that the D-shaped hoop 36 is held in the proper rotational orientation each time the barb 78 engages one of the V-grooves 48.

In this first embodiment, the number of threads 42, thread pitch, and length of V-grooves 48 are configured to allow for two half-turns in either direction from a nominal central position. Of course, the number of threads 42, thread pitch, length of V-grooves 48, and length of the main shaft 32 can be modified, if so desired, to provide for a greater or lesser amount of adjustment capability. Moreover, if so desired, the bracket may have a second flexible arm and barb (not shown), located and oriented one hundred eighty degrees from the first so that both V-grooves 48 are engaged at the same time. This may, however, add more cost and complexity and increase the adjustment torque more than is desirable.

The manufacturing of the striker assembly 20 may include the bracket 60 being formed around the striker 30, if so desired. For example, if the striker 30 is metal and the bracket 60 is made of plastic or some other similar, suitable material, then the striker 30 may be insert-molded into the bracket 60. The trunnion plate 68 is molded around the main shaft 32 to form the opening 69, and the end wall 70 is molded around the threads 42 to form the threaded hole 72. In addition, the flexible arm 76 and barb 78 are molded so that the barb 78 is molded into one of the V-grooves 48. Thus, when the striker 30 is in the as-molded position, the flexible arm 76 is also in its as-molded position, and so is not flexed. The flexible arm 76 is flexed when one rotates the striker 30 sufficiently to cause the barb 78 to be pushed out of the V-groove 48.

This particular manufacturing process is advantageous in that it creates a two piece adjustable striker assembly 20 that does not require assembly after forming, while still allowing for adjustment between the D-shaped hoop 26 that engages the latch (not shown) and the mounting holes 64 where the striker assembly 20 is mounted to the door or compartment (not shown in this embodiment). Also, by forming the bracket 60 this way, the bracket can be a single, monolithic piece.

While the insert molding of a plastic bracket 60 around a metal striker 30 is a preferred method, other materials may be used and other fabrication and assembly methods may be employed instead, if so desired. For example, the bracket and striker may both be made of metal and/or the bracket formed in multiple pieces that are assembled to the striker.

The installation and adjustment of the adjustable striker assembly 20 will now be described. The mounting flanges 62 are placed in the desired location of the door or compartment, as the case may be, and the fasteners (not shown in this embodiment) are installed through the mounting holes 64 to secure the striker assembly 20 in place. If the D-shaped hoop 36 is in the proper location for engagement with the latch, then no further adjustment needs to be made. If the D-shaped hoop 36 does not engage properly with the latch, then the hoop 36 is grasped and rotated one-half turn relative to the bracket 60—clockwise or counterclockwise depending upon the direction of misalignment. If additional adjustment is needed, then it can be rotated another half turn.

When the D-shaped hoop 36 is grasped and a significant level of torque is applied, the torque causes the barb 78 of the flexible arm 76 to be flexed out of the V-groove 48. This then releases the main shaft 32 to continue rotation through one hundred eighty degrees. At that time, the barb 78 aligns with the opposite V-groove 48, allowing the arm 76 to flex back and bias the barb 78 into this opposite V-groove 48. This will hold the striker 30 in its new position and correct orientation relative to the bracket 60. One will note that the adjustment has been accomplished without the need for any tools. Thus, if misalignment should occur due to installation of an instrument panel (not shown) into a vehicle body (not shown), adjustment can be made quickly and easily. One will also note that the amount of torque required to cause rotation of the striker 30 relative to the bracket 60 may be easily tuned during design of the bracket 60 for a particular application by making small changes to the thickness of the flexible arm 76 and/or changes to the barb 78 and V-groove 48.

Figure 5:
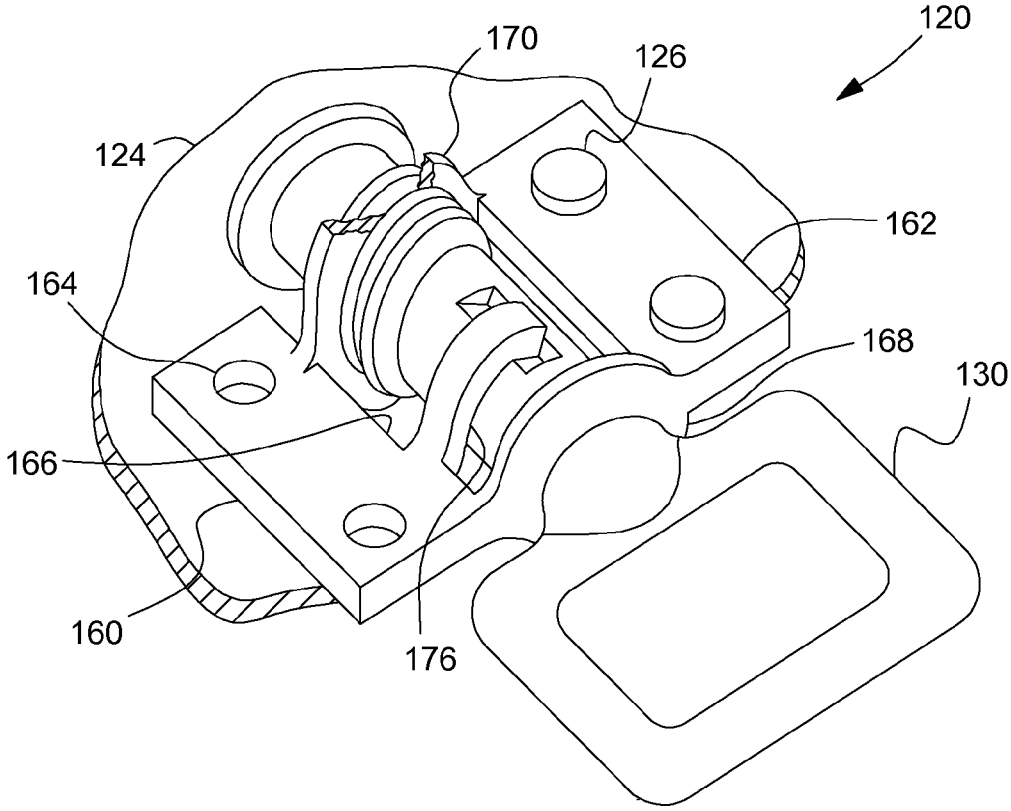
FIG. 5 is a perspective view of a striker assembly and mounting location according to a second embodiment.
Figure 6:
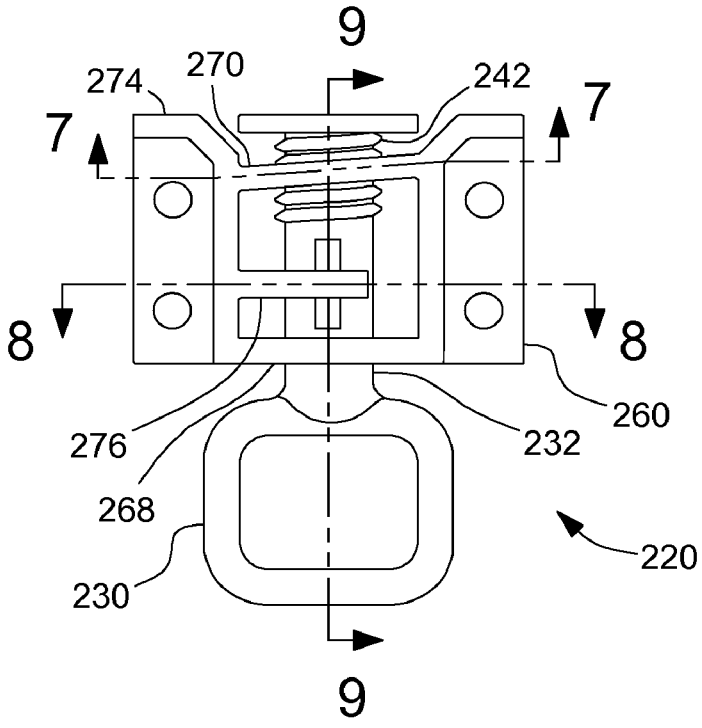
FIG. 6 is a plan view of a striker assembly according to a third embodiment.
Figure 7:
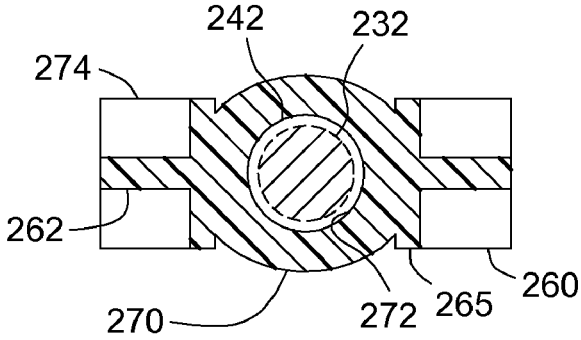
FIG. 7 is a section view taken along line 7-7 in FIG. 6.
Figure 8:
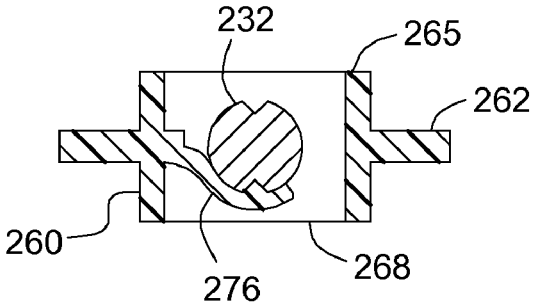
FIG. 8 is a section view taken along line 8-8 in FIG. 6.
Figure 9:
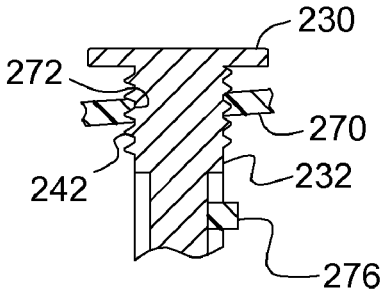
FIG. 9 is a partial section view taken along line 9-9 in FIG. 6.

FIG. 5 illustrates a second embodiment. This embodiment has many items in common with that of the first embodiment, and to avoid unnecessary repetition of the description, the same reference numerals have been used but falling within the 100-series. The striker assembly 120 is shown mounted to a door or compartment 124, as the case may be, and held in place with fasteners 126 (only two shown) that engage mounting holes 164 in the mounting flanges 162. The striker 130 may be the same as in the first embodiment, if so desired, while the bracket 160 has changed somewhat.

In this embodiment, the side support walls and rear support walls have been eliminated. So, the trunnion plate 168, end wall 170, and flexible arm 176 extend directly from the mounting flanges 162. Also, the edges of the mounting flanges 162 now define the central opening 166. The fabrication of the striker assembly 120 and method of adjustment may be the same as in the first embodiment.

FIGS. 6-9 illustrate a third embodiment. This embodiment has many items in common with that of the first embodiment, and to avoid unnecessary repetition of the description, the same reference numerals have been used but falling within the 200-series. For this striker assembly 220, the striker 230 may again be the same as in the first embodiment, if so desired, while the bracket 260 has changed.

The flexible arm 276, mounting flanges 262, side support walls 265, trunnion plate 268 and rear support walls 274 may be the same as in the first embodiment. In this embodiment, however, the end wall 270 is canted to match the angle of the threads 242 on the main shaft 232. While this end wall 270 and threaded hole 272 may possibly be easier to mold around the threads 242 than the first embodiment, it may induce more friction between the threads 242 and the threaded hole 272 than the configuration in the first embodiment.

While certain embodiments of the present invention have been described in detail, those familiar with the art to which this invention relates will recognize various alternative designs and embodiments for practicing the invention as defined by the following claims.

What is claimed is:

1. A striker assembly for use with a closure for a vehicle compartment, the striker assembly comprising:

a striker having a main shaft with a first end and an opposed second end, a hoop extending from the first end, threads extending around the main shaft, and a rotational retention feature adjacent to the threads on the main shaft; and a bracket having a pair of mounting flanges adapted to be mounted to one of the closure and the vehicle compartment, a first wall including a threaded hole therethrough that operatively engages the threads on the main shaft, a second wall, spaced from the first wall, having a hole therethrough that engages the main shaft to allow for axial and rotational movement of the main shaft relative to the second wall, and a flexible arm having a catch operatively engageable with the rotational retention feature; the striker being rotatably adjustable with respect to the bracket wherein when the striker is not adjusted, the flexible arm is relaxed having the catch positioned within the rotational retention feature, holding the striker in place with respect to the bracket, and when the striker is adjusted, the flexible arm is flexed with respect to the catch not being positioned within the rotational retention feature, allowing the rotational movement of the striker to a desired position.

2. The striker assembly of claim 1 wherein the rotational retention feature is a V-groove recessed in and extending axially along the main shaft, and the catch is a barb operatively engageable with the V-groove.

3. The striker assembly of claim 1 wherein the striker includes a second rotational retention feature on the main shaft that is axially aligned with and rotationally one hundred eighty degrees from the rotational retention feature.

4. The striker assembly of claim 1 wherein the bracket includes a pair of spaced apart side walls extending normal to the mounting flanges and defining a central opening through which the main shaft extends, the spaced apart side walls supportively engaging the first wall and the second wall in the central opening.

5. The striker assembly of claim 1 wherein the hoop is a D-shaped hoop.

6. The striker assembly of claim 1 wherein the striker includes a retention flange extending from the second end that has a larger diameter than a diameter of the main shaft.

7. The striker assembly of claim 1 wherein the rotational retention feature is located between the threads and the hoop.

8. The striker assembly of claim 1 wherein the first wall is adjacent to the second end of the main shaft and the second wall is a trunnion plate that is adjacent to first end of the main shaft.

9. The striker assembly of claim 1 wherein the first wall is parallel to the second wall.

10. The striker assembly of claim 1 wherein the first wall is oriented substantially parallel to the threads.

11. A striker assembly mounted to a vehicle glove box and adapted to engage a latch of a glove box door, the striker assembly comprising:

an adjustable striker having a main shaft with a first end and an opposed second end, a hoop extending from the first end and adapted to engage the latch, threads extending around the main shaft adjacent to the second end, and a rotational retention feature on the main shaft between the threads and the hoop; and a bracket having a pair of mounting flanges mounted to the vehicle glove box, a first wall including a threaded hole therethrough that operatively engages the threads on the main shaft, a second wall, spaced from the first wall, having a hole therethrough that engages the main shaft adjacent to the first end, and a flexible arm having a catch operatively engageable with the rotational retention feature, the bracket being a single, monolithic piece; wherein when the striker is not adjusted, the flexible arm is relaxed having the catch engageable with the rotational retention feature, holding the striker in place with respect to the bracket, and when the striker is adjusted, the flexible arm is flexed with respect to the catch not being engaged with the rotational retention feature, allowing the rotational movement of the striker to a desired position.

12. The striker assembly of claim 11 wherein the rotational retention feature is a V-groove recessed in and extending axially along the main shaft, and the catch is a barb operatively engageable with the V-groove.

13. The striker assembly of claim 11 wherein the striker includes a second rotational retention feature on the main shaft that is axially aligned with and rotationally one hundred eighty degrees from the rotational retention feature.

14. The striker assembly of claim 11 wherein the bracket includes a pair of spaced apart side walls extending normal to the mounting flanges and defining a central opening through which the main shaft extends, the spaced apart side walls supportively engaging the first wall and the second wall in the central opening.

15. The striker assembly of claim 11 wherein the first wall is parallel to the second wall.

* * * * *